US006001545A

United States Patent [19]

Foster et al.

[11] Patent Number: 6,001,545

[45] Date of Patent: Dec. 14, 1999

[54] PHOTOGRAPHIC FIXING COMPOSITION AND METHOD OF RAPID PHOTOGRAPHIC PROCESSING

[75] Inventors: David G. Foster, W. Henrietta; Eric R. Schmittou, Rochester, both of N.Y.

[73] Assignee: Eastman Kodak Company, Rochester, N.Y.

[21] Appl. No.: 09/223,597

[22] Filed: Dec. 30, 1998

[51] Int. Cl.[6] ..... G03C 7/42

[52] U.S. Cl. ..... 430/455; 430/393; 430/458; 430/459

[58] Field of Search ..... 430/455, 458, 430/459

[56] References Cited

U.S. PATENT DOCUMENTS

| | | | |
|---|---|---|---|
| H953 | 8/1991 | Goto et al. | 430/393 |
| 4,960,683 | 10/1990 | Okazaki et al. | 430/428 |
| 5,026,629 | 6/1991 | McGuckin et al. | 430/428 |
| 5,183,727 | 2/1993 | Schmittou et al. | 430/372 |
| 5,298,373 | 3/1994 | Sasaoka et al. | 430/429 |
| 5,401,621 | 3/1995 | Kojima et al. | 430/393 |
| 5,415,983 | 5/1995 | Kojima et al. | 430/455 |
| 5,424,176 | 6/1995 | Schmittou et al. | 430/429 |
| 5,633,124 | 5/1997 | Schmittou et al. | 430/372 |
| 5,795,703 | 8/1998 | Ishikawa | 430/393 |
| 5,814,437 | 9/1998 | Nakahanada et al. | 430/455 |

FOREIGN PATENT DOCUMENTS

| | | |
|---|---|---|
| 0 189 603 | 8/1986 | European Pat. Off. . |
| 0 466 510 | 1/1992 | European Pat. Off. . |
| 0 500 045 | 8/1992 | European Pat. Off. . |
| 0 513 766 | 11/1992 | European Pat. Off. . |
| 0 329 052 | 10/1993 | European Pat. Off. . |
| 0 712 040 | 5/1996 | European Pat. Off. . |

OTHER PUBLICATIONS

Japanese Abstract No. 5034872.
Japanese Abstract No. 610763.
Japanese Abstract No. 7120895.
Japanese Abstract No. 8248582.
Japanese Abstract No. 9005964.
Japanese Abstract No. 58122535.
Japanese Abstract No. 1004739.
Symposium on Photofinishing Technology (SPSE), Feb. 1990 (Las Vegas,NV).

*Primary Examiner*—Hoa Van Le
*Attorney, Agent, or Firm*—J. Lanny Tucker

[57] ABSTRACT

Color photographic silver halide elements, such as color films, can be rapidly fixed using a fixing composition containing a mixture of thiosulfate and thiocyanate fixing agents, and certain sulfur-containing 1,2,4-triazoles. Each of the components is present in specific amounts to effect rapid and efficient desilvering. The composition also includes predominantly ammonium cations (at least 50 mol %). Besides effective and rapid silver removal (up to 50 seconds), the fixing composition also minimizes residual dye stain from sensitizing dye aggregates within the photographic elements.

26 Claims, 1 Drawing Sheet

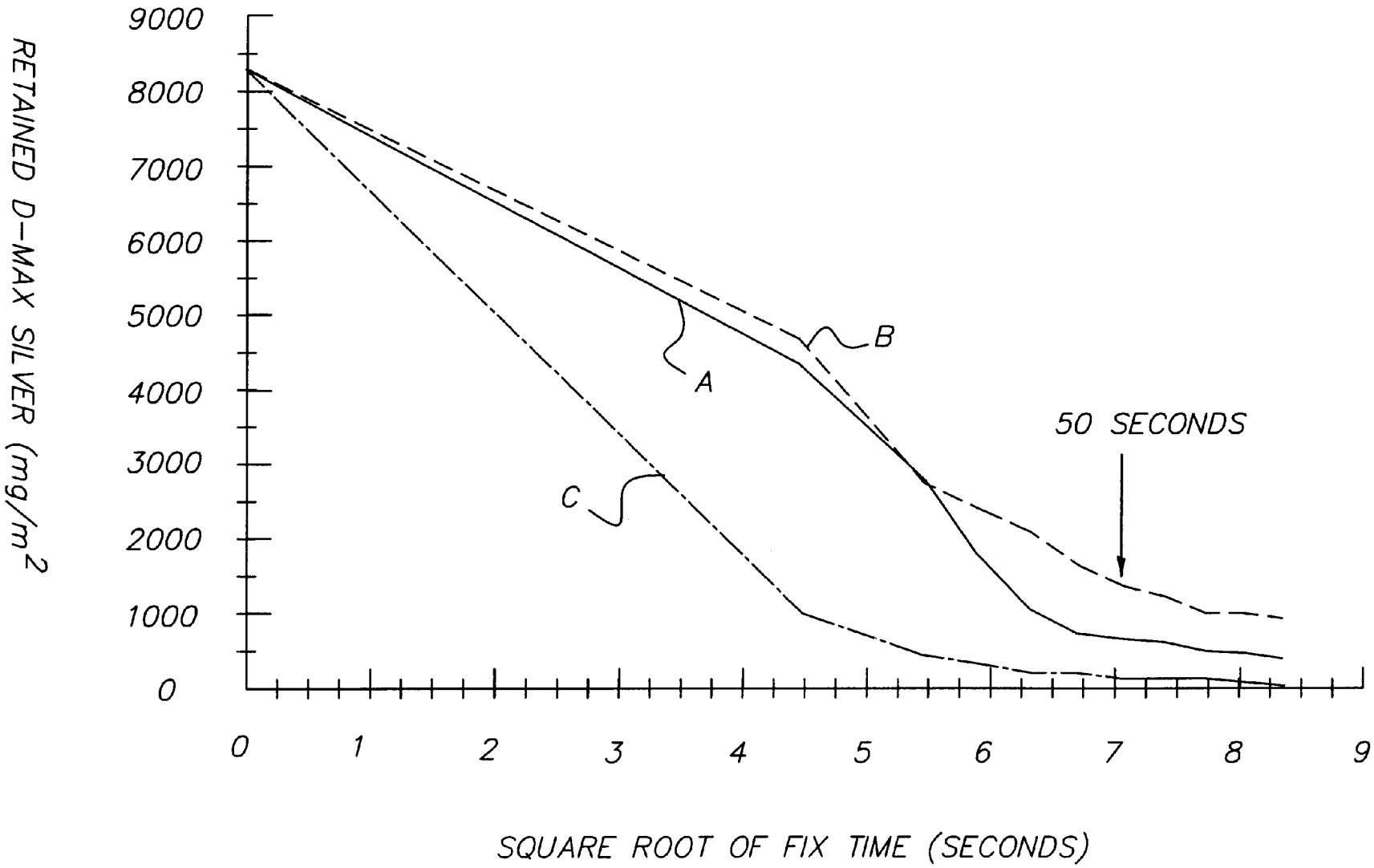
50 SECONDS
A
B
C
0
1
2
3
4
5
6
7
8
9
SQUARE ROOT OF FIX TIME (SECONDS)
9000
8000
7000
6000
5000
4000
3000
2000
1000
0
RETAINED D-MAX SILVER (mg/m2

PHOTOGRAPHIC FIXING COMPOSITION AND METHOD OF RAPID PHOTOGRAPHIC PROCESSING

PENDING APPLICATION

Reference is made to copending and commonly assigned U.S. Ser. No. 09/223,292 filed on even date herewith by Schmittou and Foster and entitled "Photographic Fixing Composition with Mixture of Fixing Agents and Method of Rapid Processing".

FIELD OF THE INVENTION

This invention relates in general to photography. More particularly, it relates to a photographic fixing composition, and to a method of rapidly processing color photographic silver halide elements using that composition while obtaining low levels of dye density stain.

BACKGROUND OF THE INVENTION

The basic image-forming process of silver halide color photography comprises the exposure of a silver halide photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver(I), the silver(I) is generally removed by dissolving it in a silver(I) solvent, commonly known as a fixing agent. Conventional fixing steps generally require up to 6 minutes in large photoprocessing operations, and up to 2 minutes in small "minilabs" or small processing machines.

In some photochemical processes, bleaching and fixing are combined in a bleach-fixing step using a composition that includes both a bleaching agent to oxidize metallic silver and a fixing agent to dissolve the remaining silver(I).

A wide variety of fixing agents and silver solvents are known, as described for example in U.S. Pat. No. 5,633,124 (Schmittou et al) and publications noted therein. Thiosulfate salts are generally preferred as fixing agents because they are inexpensive, highly water soluble, non-toxic, non-odorous, and stable over a wide pH range. Thus, fixing is usually accomplished using a thiosulfate fixing agent that diffuses into the element, and forms silver thiosulfate complex that diffuses out of the element. In large photofinishing labs, the elements are usually immersed in a fixing solution for from 4 to 6 minutes. In small minilabs, the fixing time is shorter, that is from 90 to 120 seconds.

In processing some photographic elements, such as color negative photographic films, there is a need to reduce density from stain resulting from sensitizing dye aggregates formed from sensitizing dyes commonly included in the elements to increase silver halide spectral sensitivity. After the photographic elements are exposed, the spectral dyes are no longer needed, and the aggregates they form interfere with the absorption characteristics of the colored dyes that provide the final color images.

When using conventional fixing times, the unwanted dye aggregates disappear after the prescribed lengthy fixing and stabilizing (or washing steps). Substantial amounts of the sensitizing dyes remain in the color negative films after processing, but they are in invariant and unaggregated forms that absorb blue and green light. The absorbance by the retained unaggregated sensitizing dyes can be compensated for when final positive images are produced from the negative film images. However, when the fixing time is shortened, dye aggregates and resulting dye stains remain. This problem in the original image (such as color negative film images) is unacceptable in the photographic industry. It is also unacceptable for such images as color slides or transparencies, color prints or electronic images obtained from scanning original images.

It is well known that the rate of silver dissolution (or complexation) by thiosulfate fixing agents increases with increasing thiosulfate concentration until a maximum rate is reached. After this maximum rate is reached, the rate of silver dissolution decreases as the thiosulfate concentration is increased further. Consequently, other compounds are routinely incorporated into fixing solutions to act as co-fixing agents or fixing accelerators to improve silver removal. Thiocyanate is one of the most common compounds used for this purpose.

There are several fixing solutions available in the marketplace containing a combination of thiosulfate and thiocyanate for use in a 90–120 second fixing step. One such product is available as KODAK FLEXICOLOR RA Fixer Replenisher NR having thiosulfate and thiocyanate at 0.8 and 1.2 mol/l, respectively (1:1.5 molar ratio).

There are also numerous literature references to the combination of thiosulfate and thiocyanate including EP-A-0 610 763 (Buttner et al) that describes fixing for 90 to 240 seconds. However, this publication fails to appreciate the need to avoid sensitizing dye aggregate stains.

EP-A-0 712,040 (Ueda et al) describes the inclusion of organic sulfur-substituted compounds in fixing solutions that contain only thiosulfate. EP-A-0 189,603 (Rutges et al) describes the use of mercaptotriazole and thiosulfate in a combined fixing-stabilizing solution for processing silver halide materials containing at least 50 mol % silver chloride. EP-A-0 500,045 (Kojima et al) describes the use of mercaptoazoles as fixing agents.

U.S. Pat. No. 4,960,683 (Okazaki et al) describes the use of various heterocyclic thiols in thiosulfate fixers, in subsequent wash solutions, or in subsequent stabilizing solutions for the purpose of removing and washing out sensitizing dyes from black-and-white photographic materials. There is no mention of the action of such heterocyclic thiols on sensitizing dyes in silver halide color photographic systems, particularly aggregated sensitizing dye color negative film systems. The break-up of sensitizing dye aggregates into unaggregated forms and the elimination of aggregated sensitizing dye stain are the subjects of our invention.

There is a continuing need to provide images in photographic elements in a more rapid fashion. The industry is attempting to provide images to customers in less time, and thus a time reduction in any of the processing steps, including fixing, is highly desirable. The combination of thiosulfate and thiocyanate in conventional amounts is insufficient to complete the desilvering process in a more rapid fashion while eliminating unwanted dye stain from sensitizing dye aggregates.

SUMMARY OF THE INVENTION

An advance is provided in the art with a fixing composition comprising:

a) from about 0.8 to about 1.6 mol/l of a thiosulfate fixing agent, b) at least 2 mol/l of a thiocyanate fixing agent, and c) at least 0.001 mol/l of a 1,2,4-triazole of Structure I or any of its tautomeric forms:

Structure I

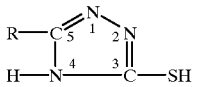

wherein R is hydrogen or a monovalent substituent having up to 12 atoms other than hydrogen atoms, and one of the hydrogen atoms on the nitrogen atoms in the triazole ring or any of its tautomeric forms can be replaced by the same or different substituent as defined for R, provided that none of the substituents is an aminoalkyl group, and any two adjacent substituents can together form a fused ring with the triazole ring, wherein the concentration of ammonium ions is at least 50 mol % of all cations in the composition.

This fixing composition can be used in a method for photographic processing by contacting an imagewise exposed and color developed color photographic silver halide element with the fixing composition described above for up to 50 seconds.

We have found that shortened fixing times for photographic processing can be carried out with successful silver removal and reduction of sensitizing dye aggregate stain by using specific amounts of thiosulfate and thiocyanate fixing agents and certain 3-mercapto-1,2,4-triazoles as the essential components of the fixing composition of this invention. In particular, the addition of the triazole compound to the fixing composition improves photographic fixing over the use of a mixture of the thiosulfate and thiocyanate fixing agents alone. Moreover, the concentration of ammonium cations in the composition should be at least 50 mol % of all cations. In the practice of this invention, at least 95% of the original removable silver(I) is dissolved during fixing with the present invention, and the residual stain density from residual sensitizing dye aggregates is less than 0.05 density units within the region of 600–700 nm. Further details of how these advantages are accomplished are provided below.

BRIEF DESCRIPTION OF THE DRAWING

FIG. 1 is a graphical representation of data obtained in the experiments described in Example 2 below.

DETAILED DESCRIPTION OF THE INVENTION

The fixing compositions used in this invention generally have a pH of from about 4 to about 8 when in aqueous form. Preferably, the pH is from about 5 to about 8, and more preferably, it is from about 6 to about 8.

The fixing composition can be packaged and transported as a dry or liquid formulation, working strength solution, or as a single-part concentrated composition. It can be used as a replenisher as well as the initial tank working solution.

It should be understood that the fixing compositions of this invention are intended for rapid and efficient removal of silver(I) from photographic elements, either before, during or after bleaching or any combination of these. In the case of bleach-fixing, the fixing composition of this invention can also include useful amounts of one or more bleaching agents (such as iron chelates) that are purposely added to the fixing composition in some manner. Preferably, however, the useful fixing compositions have fixing activity only (no purposely added bleaching agents), and the only bleaching agents that may be present in the fixing composition are those carried over from a preceding bleaching solution by the photographic element being processed.

The first essential component in the fixing composition is a thiosulfate fixing agent that can be provided as sodium thiosulfate, potassium thiosulfate, ammonium thiosulfate, lithium thiosulfate, calcium thiosulfate, or magnesium thiosulfate, or mixtures thereof such that the desired concentration of thiosulfate ion is provided. Preferably, ammonium or sodium thiosulfate (or a mixture thereof) is used.

A second essential component is a thiocyanate fixing agent that can be provided as sodium thiocyanate, potassium thiocyanate or ammonium thiocyanate, or mixtures thereof. Preferably ammonium or sodium thiocyanate (or mixtures thereof) is used.

One or more organic sulfur-substituted triazoles of Structure I (or any tautomeric form thereof) are included in the fixing composition as a third essential component.

Structure I

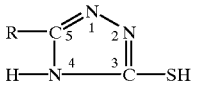

wherein R is hydrogen or a monovalent substituent, generally having up to 12 non-hydrogen atoms (for example, carbon, nitrogen, oxygen, phosphorus and sulfur atoms). Particularly useful substituents are aliphatic, alicyclic and aromatic groups as defined below. In addition, two adjacent substituents on the triazole ring (or any tautomeric form thereof) can be combined to form a fused ring. Such fused rings can have from 5 to 8 carbon, oxygen, sulfur or nitrogen atoms, including the 2 atoms shared with the triazole ring.

Particularly useful aliphatic, alicyclic and aromatic groups include but are not limited to substituted or unsubstituted alkyl groups each having 1 to 8 carbon atoms in the alkyl portion (such as methyl, ethyl, isopropyl, t-butyl, hexyl, benzyl, methoxymethyl, 2-sulfoethyl, carboxymethyl, hydroxyethyl, hydroxymethyl, methylthiomethyl, carboxymethylthioethyl, phosphonomethyl and hydroxyethoxyethyl), substituted or unsubstituted cycloalkyl groups each having 5 to 10 carbon atoms in the ring structure (such as cyclopentyl, cyclohexyl, 4-methoxycyclohexyl, 3-methylcyclohexyl, 4-carboxycyclohexyl, 3-sulfocyclohexyl, 2-hydroxycyclopentyl), substituted or unsubstituted carbocyclic aryl groups each having 6 to 10 carbon atoms (such as phenyl, p-methoxyphenyl, m-methylphenyl, naphthyl, 2-carboxyphenyl, 3-hydroxyphenyl, 4-sulfophenyl, 2-methylthiophenyl), substituted or unsubstituted alkoxy groups each having 1 to 10 carbon atoms (such as methoxy, ethoxy, t-butoxy, methoxyethoxy, methylthioethoxy, 2-hydroxyethoxy, 2-carboxyethoxy, 2-sulfoethoxy and phenylmethoxy), substituted or unsubstituted aryloxy groups each having 6 to 10 carbon atoms in the carbocyclic ring (such as phenoxy, naphthoxy, 2-hydroxyphenoxy, 4-sulfophenoxy, 3-carboxyphenoxy and p-methylphenoxy), primary, secondary and tertiary amino groups [such as —$NH_2$, methylamino, ethylamino, carboxymethylamino, 2-sulfoethylamino, 2-hydroxyethylamino, acetylamino, phosphonomethylamino, methylthioethylamino, 3-sulfophenylamino, bis(2-hydroxyethyl)amino and N,N-dimethylamino], acyl groups having 2 to 8 carbon atoms (such as acetyl, formyl, benzoyl, 2-carboxybenzoyl, 3-sulfobenzoyl, 4-hydroxybenzoyl and 2-carboxypropionyl), substituted or unsubstituted heterocyclyl groups having 5 to 10 carbon, sulfur, nitrogen or oxygen atoms in the ring (including both aromatic and nonaromatic heterocyclyl groups, such as morpholino, 2-pyridyl, 2-imidazolyl, 2-imidazolidinyl, 2-pyrimidinyl, 2-thiazolyl, 2-thiazolidinyl, 2-oxazolyl and 2-oxazolidinyl), substituted or unsubstituted alkylthio groups having 1 to 8 carbon atoms (such as methylthio, methoxyethylthio, methylthioethylthio, 2-hydroxyethylthio, carboxymethylthio and 2-sulfoethylthio), and substituted or unsubstituted arylthio groups having 6 to 10 carbon atoms in the ring (such as phenylthio, 2-carboxyphenylthio, 4-sulfophenylthio, 3-hydroxyphenylthio and 1- or 2-naphthylthio).

Any one of the nitrogen atoms in the triazole ring (any tautomer) that has an open valence (that is, has a hydrogen atom) can also be substituted with a substituent as defined above. Preferably, the one such substituent is attached to the 2- or 4-position, and more preferably at the 4-position, of the triazole ring.

Where the triazole ring includes two adjacent substituents that are combined, the resulting fused ring can be saturated or unsaturated (for example an imidazole ring, an oxazole ring, a thiazole ring, pyrrolidine ring or a pyrimidine ring).

Preferably, the one or two substituents on the triazole ring are aliphatic groups that are independently alkyl groups, sulfoalkyl groups (wherein the alkyl portion is as defined above), or amino groups as defined above. More preferably, they are sulfoalkyl groups (such as sulfomethyl or 2-sulfoethyl) or alkyl groups (such as methyl or ethyl).

In preferred embodiments, the compounds of Structure I are further represented by Structure Ia:

Structure Ia

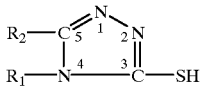

wherein $R_1$ and $R_2$ are independently hydrogen, a substituted or unsubstituted alkyl group (as defined above), or a substituted or unsubstituted amino group (as defined above). Representative preferred alkyl groups include, but are not limited to linear or branched alkyl groups having 1 to 4 carbon atoms (more preferably 1 or 2 carbon atoms) that can be substituted with one or more hydroxy, carboxy, phosphono or sulfo groups (or their salts). Sulfo substituents are particularly preferred.

Preferably, $R_1$ and $R_2$ are independently hydrogen, —$NH_2$, methyl or 2-sulfoethyl, and more preferably, both are hydrogen.

As one skilled in the art would understand, the compounds shown in Structure I can also exist in their tautomeric forms wherein the ═S group is a —SH group Representative useful sulfur-substituted compounds include, but are not limited to the following Compounds 1–22:

1

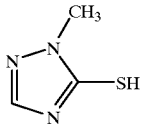

2

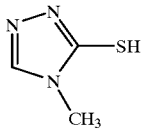

-continued

3

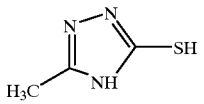

4

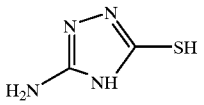

5

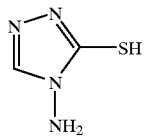

6

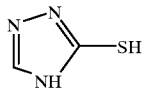

7

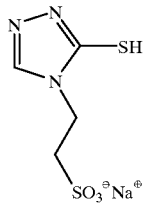

8

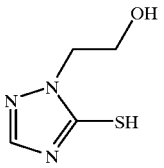

9

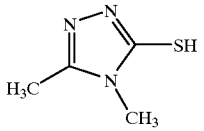

10

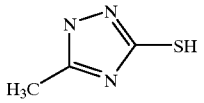

11

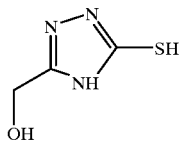

12

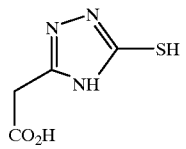

-continued

13

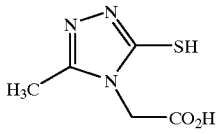

14

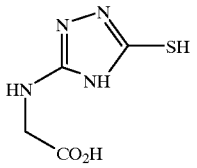

15

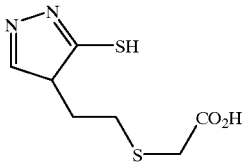

16

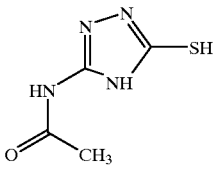

17

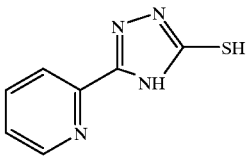

18

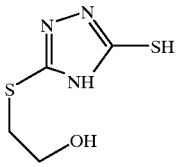

19

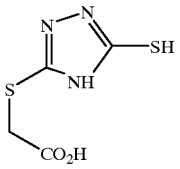

20

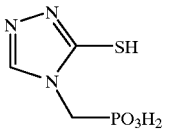

-continued

21

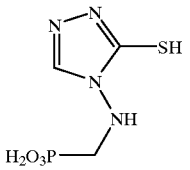

22

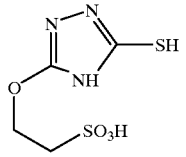

Compounds 2, 4, 6 and 7 are preferred, and Compounds 6 and 7 are most preferred. Other useful compounds would be readily apparent to one skilled in the art in view of the teaching included herein.

The thiosulfates, thiocyanates and the structure I compounds described above can be obtained from a number of commercial sources or readily prepared using conventional procedures and starting materials.

The concentrations of the essential components of the fixing composition of this invention are listed in TABLE I below wherein all of the ranges of concentrations are considered to be approximate (that is "about").

TABLE I

| COMPONENT | GENERAL CONCENTRATION (mol/l) | PREFERRED CONCENTRATION (mol/l) |
|---|---|---|
| Thiosulfate ions | 0.8–1.6 | 1–1.5 |
| Thiocyanate ions | ≧2 | 2–3 |
| Structure I compound | ≧0.001 | 0.005–0.05 |
| Ammonium ions | ≧50 mol % of all cations | ≧75 mol % of all cations |

Optional addenda that can be present in the fixing composition if desired are materials that do not materially affect the photographic fixing function of the composition. Such materials include, but are not limited to, biocides, a source of sulfite or bisulfite ion, alkyl- or arylsulfinic acids or their salts, halides (such as bromide ions, chloride ions or iodide ions), photographic hardeners, metal ion sequestering agents, buffers, fixing accelerators, and other materials readily apparent to one skilled in the photographic art. These and other optional materials can be present in conventional amounts (for example as described in U.S. Pat. No. 5,633,124, noted above and incorporated herein by reference).

The components of the fixing composition of this invention can be mixed together in any suitable order as would be known in the art, and stored indefinitely or used immediately as liquid or solid formulations. They can be formulated in aqueous concentrates such that dilution up to 10 times is required during use. Alternatively, they can be formulated as solid compositions (tablets, pellets, powders or granules) and added to a processing tank with appropriate amounts of water for use.

During photographic processing, conventional procedures can be used for replenishment of the various processing solutions, including the fixing solution. Preferably, the rate of fixing solution replenishment is not more than 3000 $ml/m^2$, and preferably from about 250 to about 1500 $ml/m^2$ of processed photographic film. The processing equipment can be any suitable processor having one or more processing tanks or vessels, including minilab processors and larger scale processors. The fixing step can be carried out in one or more tanks or stages arranged in concurrent or countercurrent flow. Generally, fixing is carried out in a two-tank or two-stage processing configuration, but single-tank or single-stage processing can also be used.

The present invention can be used advantageously with any of the known methods of applying fixing compositions to photographic elements. These methods include, but are not limited to, immersing the element into an aqueous fixing solution (with or without agitation or circulation), bringing the element into contact with a web or drum surface that is wet with the fixing composition, laminating the element with a cover sheet or web in such a way that fixing composition is brought into contact with the element, or applying the fixing composition to the element by high velocity jet or spray.

The fixing step can be carried out at a temperature of from about 20 to about 60° C. (preferably from about 30 to about 50° C.). The time of processing during this fixing step is generally up to 50 seconds and preferably at least 30 and up to 45 seconds. Optimal processing conditions are at 30° C. or higher temperatures. In some embodiments, higher fixing temperatures, for example from about 35 to about 55° C. can provide even more rapid fixing and minimized sensitizing dye aggregate stain in the practice of this invention.

The other processing steps can be similarly rapid or conventional in time and conditions. Preferably the other processing steps, such as color development, bleaching and stabilizing (or rinsing), are likewise shorter than conventional times. For example, color development can be carried out for from about 12 to about 150 seconds, bleaching for from about 12 to about 50 seconds, and stabilizing (or rinsing) for from about 15 to about 50 seconds in rapid processing protocols. The fixing step can be carried out more than once in some processes. These processing methods can have any of a wide number of arrangement of steps, as described for example in U.S. Pat. No. 5,633,124 (noted above). In such rapid processing methods, the total processing time for color negative films, can be up to 300 seconds (preferably from about 120 to about 300 seconds), and the total processing time for color negative papers can be up to 100 seconds (preferably from about 50 to about 100 seconds).

More rapid fixing times and reduced sensitizing dye aggregate stain can be brought about by higher fixing temperature, lower overall silver coverage in the processed elements, reduced silver iodide in the processed elements, reduced amounts of sensitizing dyes (especially the cyan colored dye aggregates), using sensitizing dyes with increased aqueous solubility or decreased strength of adsorption to silver halide, thinner processed elements or a greater swollen thickness to dry thickness ratio of the processed elements. Also, lower silver and/or halide (especially iodide) concentrations in the seasoned fixing composition can bring about the desired results.

The present invention can therefore be used to process silver halide elements of various types including color papers (for example EKTACOLOR RA-4), color motion picture films and prints (for example Process ECP, Process ECN and Process VNF-1), and color negative (for example Process C-41) or color reversal (for example Process E-6) films, with or without a magnetic backing layer or stripe. The various processing sequences, conditions and solutions for these processing methods are well known in the art. Preferably, color negative films (including those having a magnetic backing layer) are processed using this invention.

The emulsions and other components, and element structure of photographic materials used in this invention and the various steps used to process them are well known and described in considerable publications, including, for example, *Research Disclosure*, publication 38957, pages 592–639 (September 1996) and hundreds of references noted therein. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below. The invention can be practiced with photographic films containing any of many varied types of silver halide crystal morphology, sensitizers, color couplers, and addenda known in the art, as described in the noted *Research Disclosure* publication and the many publications noted therein. The films can have one or more layers, at least one of which is a silver halide emulsion layer that is sensitive to electromagnetic radiation, disposed on a suitable film support (typically a polymeric material).

The processed color negative films may have a magnetic recording layer, or stripe, on the support opposite the silver halide emulsion layer(s). Formulations for preparing magnetic recording layers are also well known in the art, as described for example, in *Research Disclosure*, publication 34390, November, 1992, U.S. Pat. No. 5,395,743 (Brick et al), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. While the magnetic recording layer can cover only a portion of the surface of the support, generally it covers nearly the entire surface, and can be applied using conventional procedures including coating, printing, bonding or laminating.

Various supports can be used for such color negative films processed according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane-4,4'-dicarboxylate and poly (butylene terephthalate) are preferred. These materials can be subbed or unsubbed and coated with various antihalation, antistatic or other non-imaging layers as is known in the art. Particularly useful antistatic layers on the backside of the elements include vanadium pentoxide in a suitable binder.

Representative photographic elements that can be processed to advantage using the present invention include, but are not limited to, KODAK ROYAL GOLD Color Films (especially the 1000 speed color film), KODAK GOLD MAX 400 and 800 Color Films, KODAK ADVANTIX Color Films, KODAK VERICOLOR III Color Films, KONICA VX400 Color Film, KONICA Super SR400 Color Film, FUJI SUPER HG400 Color Film, FUJI SUPERG 200 Color Film and LUCKY GBR100 Color Film. Other elements that could be used in the practice of this invention would be readily apparent to one skilled in the art.

Reagents for color development compositions are well known, and described, for example, in *Research Disclosure* (noted above), sections XVIII and XIX, and the many references described therein. Thus, besides a color developing agent, the color developers can include one or more buffers, antioxidants (or preservatives, such as sulfo-, carboxy- and hydroxy-substituted mono- and dialkylhydroxylamines), antifoggants, fragrances, solubilizing agents, brighteners, halides, sequestering agents and other conventional addenda. Representative teaching about color developing compositions can also be found in U.S. Pat. No. 4,170,478 (Case et al), U.S. Pat. No. 4,264,716 (Vincent et al), U.S. Pat. No. 4,482,626 (Twist et al), U.S. Pat. No. 4,892,804 (Vincent et al), and U.S. Pat. No. 5,491,050 (Brust et al).

Preferred antioxidants useful in the color developing compositions are mono- or dialkylhydroxylamines having one or more hydroxy substituents on the one or more alkyl groups. Representative compounds of this type are described for example in U.S. Pat. No. 5,709,982 (Marrese et al), incorporated herein by reference with respect to these compounds.

Bleaching compositions are also well known, as described for example, in *Research Disclosure* (noted above), section XX and the many references noted therein. Common bleaching agents for such compositions include, but are not limited to, ferric salts or ferric binary or ternary complexes of aminopolycarboxylic acids of many various structures including but not limited to ethylenediaminetetraacetic acid, iminodiacetic acid, methyliminodiacetic acid, ethylenediaminedisuccinic acid (either the S,S isomer alone or a racemic mixture of isomers), ethylenediaminemonosuccinic acid, and others as described for example in U.S. Pat. No. 5,334,491 (Foster et al), U.S. Pat. No. 5,582,958 (Buchanan et al), U.S. Pat. No. 5,585,226 (Strickland et al), U.S. Pat. No. 5,652,085 (Wilson et al), U.S. Pat. No. 5,670,305 (Gordon et al), and U.S. Pat. No. 5,693,456 (Foster et al), all incorporated herein by reference.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gormel), U.S. Pat. No. 4,923,782 (Schwartz), U.S. Pat. No. 4,927,746 (Schwartz), U.S. Pat. No. 5,278,033 (Hagiwara et al), U.S. Pat. No. 5,441,852 (Hagiwara et al), U.S. Pat. No. 5,529,890 (McGuckin et al), U.S. Pat. No. 5,534,396 (McGuckin et al), U.S. Pat. No. 5,578,432 (McGuckin et al), U.S. Pat. No. 5,645,980 (McGuckin et al), and U.S. Pat. No. 5,716,765 (McGuckin et al), all incorporated herein by reference.

Processing according to the present invention can be carried out using conventional tanks containing processing solutions. Alternatively, it can be carried out using what is known in the art as "low volume thin tank" processing systems using either rack and tank, roller transport or automatic tray designs. Such processing methods and equipment are described, for example, in U.S. Pat. No. 5,436,118 (Carli et al) and publications cited therein.

The following examples are included for illustrative purposes only. Unless otherwise indicated, the percentages are by weight.

EXAMPLE 1

Fixing compositions having varying amounts of ammonium thiosulfate and ammonium thiocyanate were formulated. Each composition also contained disodium ethylenediaminetetraacetate (1 g/l), anhydrous sodium sulfite (20 g/l), silver bromide (8.7 g/l), ammonium iodide (0.68 g/l), Compound 6 (at 1 g/l or 0.01 mol/l), and either acetic acid or ammonium hydroxide to achieve a pH of 6.5. Ammonium ions comprised at least 50 mol % of all cations in the composition.

Samples of KODAK GOLD MAX 800 Color Film were processed after neutral exposure through a 21 step-wedge exposure target using the processing method and solutions shown in TABLE II below.

TABLE II

| PROCESSING STEP | PROCESSING SOLUTION | PROCESSING TIME |
|---|---|---|
| Color development | Kodak FLEXICOLOR Color Developer* | 3 minutes, 15 seconds |
| Bleaching | KODAK FLEXICOLOR Bleach III* | 4 minutes, 20 seconds |
| Water washing | Water | 3 minutes, 15 seconds |
| Fixing | As noted in TABLE III | Various times |
| Stabilizing | KODAK FLEXICOLOR Stabilizer LF* | 1 minute, 5 seconds |

*Commercially available from Eastman Kodak Company

The processing solutions were agitated with bursts of nitrogen bubbles and maintained as 37.8° C. in each processing step. After processing, the amount of unwanted dye stain density was determined by measuring the maximum optical density of the sensitizing dye aggregates in the region of from 600 to 700 nm in a spectrophotometric scan of the minimum density ($D_{min}$) in the film samples. A dye stain density of 0.05 density units ("DU") or less is considered acceptable because at this level the dye stain density is insufficient to be noticeable. TABLE III below shows the dye stain density measurements (density units, "DU") at various fixing times. Also, the method of the invention successfully removed at least 95% of the original silver from the processed film samples after 45 seconds of fixing.

TABLE III

| Ammonium thiosulfate (mol/l) | Ammonium thiocyanate (mol/l) | DU at 35 seconds | DU at 40 seconds | DU at 45 seconds | |
|---|---|---|---|---|---|
| 1.00 | 1.00 | 0.129 | 0.157 | 0.171 | Comparison |
| 1.00 | 1.75 | 0.057 | 0.071 | 0.086 | Comparison |
| 1.00 | 2.50 | 0 | 0 | 0 | Invention |
| 1.25 | 1.00 | 0.100 | 0.186 | 0.171 | Comparison |
| 1.25 | 1.75 | 0.057 | 0.086 | 0.171 | Comparison |
| 1.25 | 2.50 | 0.029 | 0 | 0.029 | Invention |
| 1.50 | 1.00 | 0.186 | 0.229 | 0.243 | Comparison |
| 1.50 | 1.75 | 0.071 | 0.071 | 0.057 | Comparison |
| 1.50 | 2.50 | 0 | 0 | 0.029 | Invention |

The data in TABLE III show dye density stains at the three fixing times (35, 40 and 45 seconds). In the presence of the sulfur-substituted Compound 6, acceptably low dye stain (0.05 density units or less) was observed for a fixing time as short as 35 seconds at the desired thiosulfate, thiocyanate and ammonium ion concentrations.

EXAMPLE 2

This example compares the performance of a fixing composition of this invention to the use of Control fixing compositions comprising only a thiosulfate fixing agent or a thiocyanate fixing agent in combination with Compound 6 under rapid fixing conditions.

Fixing compositions containing silver ion (5 g/l), iodide ion (0.6 g/l), Compound 6 (1 g/l or 0.01 mol/l) and one or more fixing agents were prepared and used to process samples of KODAK GOLD MAX 800 Color Negative Film as described in Example 1 above. The fixing composition of the present invention also contained ammonium thiosulfate (1.25 mol/l) and ammonium thiocyanate (2.5 mol/l). The Control A fixing composition contained only ammonium thiosulfate (1.25 mol/l) as a fixing agent, while the Control B fixing composition contained only ammonium thiocyanate (2.5 mol/l) as a fixing agent. Fixing was carried out for at least 50 seconds, and the amount of silver retained in the film samples was measured using conventional techniques at various points during the processing step.

FIG. 1 shows the results of retained silver (mg/m$^2$) with fixing time (expressed as the square root of fixing time in seconds). It can be seen that after 50 seconds of fixing, only the fixing composition of the present invention (Curve C) acceptably removed silver from the processed film samples. Use of the Control A (Curve A) and Control B (Curve B) fixing compositions did not provide the desired results because too much (more than 5% of original removable silver) silver was retained in the film samples.

The unwanted sensitizing dye aggregate stain was also evaluated in the processed film samples. The measured dye stain density in the film samples processed according to the present invention was 0.00 units. In contrast the measured dye stain densities in the film samples processed using the Control A and Control B compositions were too high (0.13 and 0.48 units, respectively).

EXAMPLE 3

Samples of KODAK GOLD MAX 800 Color Film and KODAK ADVANTIX 200 Color Film were given a $D_{min}$ and $D_{max}$ exposure through a suitable test object and then processed as follows at 37.8° C. using conventional Process C-41 conditions and processing solutions and various fixing compositions.

| | |
|---|---|
| Process C-41 Color Development | 195 seconds |
| Process C-41 Bleaching | 240 seconds |
| Water Washing | 180 seconds |
| Fixing | 50 seconds |
| Water Washing | 180 seconds |
| PHOTOFLO Rinsing | 60 seconds |

The fixing compositions were agitated using a vigorous and constant stream of nitrogen bubbles from the bottom of the fixing tank. There was only a 1–2 second crossover time between the fixing composition and the water washings. After processing, the amount of unwanted dye stain density was determined by measuring the maximum optical density of the sensitizing dye aggregates in the region of from 600 to 700 nm in a spectrophotometric scan of the minimum density ($D_{min}$) in the film samples. Dye stain density of 0.05 density units ("DU") or less is considered acceptable because at this level the dye stain density is insufficient to be noticeable. TABLE IV below shows the dye aggregate stain density measurements (density units, "DU") after fixing for 50 seconds. Also, the method of the invention successfully removed at least 98% of the original silver from the processed film samples.

The tested fixing compositions contained the following components:

| | |
|---|---|
| Ammonium thiosulfate | 200 g/l |
| Ammonium sulfite | 14.2 g/l |
| Sodium sulfite | 10.0 g/l |
| EDTA-4Na* | 1 g/l |
| Silver bromide | 16.7 g/l |
| Silver iodide | 0.93 g/l |
| Sodium thiocyanate | 2.75 mol/l |

-continued

| | |
|---|---|
| Compound 4 | (see Table IV) 0.0125 mol/l |
| pH | 6.5 |
| Water added to 1 liter | |

*EDTA is ethylenediaminetetraacetic acid.

The ammonium cation percentage was 50% in the fixers.

TABLE IV

| Color Negative Film | Compound 4 | DU at 50 seconds | Comment |
|---|---|---|---|
| KODAK GOLD MAX 800 Film | No | 0.100 | Comparison |
| KODAK GOLD MAX 800 Film | Yes | 0.05 | Invention |
| KODAK ADVANTIX 200 Film | No | 0.092 | Comparison |
| KODAK ADVANTIX 200 Film | Yes | 0.046 | Invention |

The results in TABLE IV show that sensitizing dye aggregate stain densities are lowered to acceptable amounts by fixing for only 50 seconds when sulfur-substituted Compound 4 is present in the fixer with an ammonium cation percentage of 50%.

EXAMPLE 4

Samples of KODAK GOLD MAX 800 Color Film were given a $D_{min}$ and $D_{max}$ exposure through a suitable test object and then processed as follows at 37.8° C. using conventional Process C-41 conditions and solutions except for fixing as noted below:

| | |
|---|---|
| Process C-41 color development | 195 seconds |
| Process C-41 bleaching | 240 seconds |
| Water washing | 180 seconds |
| Fixing | 40 seconds |
| Water washing | 180 seconds |
| PHOTOFLO Rinsing | 60 seconds |

Fixing was carried out at 48.9° C. Fixing agitation was accomplished by a vigorous and constant rotation of the film samples in contact with the fixing composition. There was a one second crossover time between fixing and water washing. After processing, the film samples were analyzed by visible transmission spectrophotometry to measure sensitizing dye aggregate stain density ("DU"in density units) in the region between 600 and 700 nm as described in Example 3 above.

The fixing compositions contained the following components:

| | |
|---|---|
| Ammonium thiosulfate | 200 g/l |
| Ammonium sulfite | 14.2 g/l |
| Sodium sulfite | 10.0 g/l |
| EDTA-4Na | 1 g/l |
| Silver bromide | 16.7 g/l |
| Silver iodide | 0.93 g/l |
| Sodium thiocyanate | 2.75 mol/l |
| Compound 7 | (see Table V) 0.05 mol/l |
| pH | 6.5 |
| Water added to 1 liter | |

The fixing composition had an ammonium cation percentage of 50%. TABLE V below lists the dye stain densities ("DU") observed after fixing for 40 seconds at 48.9° C. Also, the method of the invention successfully removed at least 99.5% of the original silver from the processed film samples.

TABLE V

| Compound 7 | DU at 40 seconds | Comment |
|---|---|---|
| No | 0.063 | Comparison |
| Yes | 0.038 | Invention |

TABLE V shows that sensitizing dye aggregate stain densities are lowered to acceptable amounts by fixing for only 40 seconds at 48.9° C. when sulfur-substituted Compound 7 is present in the fixer with an ammonium cation percentage of 50%.

The invention has been described in detail with particular reference to preferred embodiments thereof, but it will be understood that variations and modifications can be effected within the spirit and scope of the invention.

We claim:

1. A fixing composition comprising:

a) from about 0.8 to about 1.6 mol/l of a thiosulfate fixing agent, b) at least 2 mol/l of a thiocyanate fixing agent, and c) at least 0.001 mol/l of a 1,2,4-triazole of Structure I or any of its tautomeric forms:

Structure I

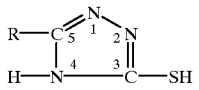

wherein R is hydrogen or a monovalent substituent having up to 12 atoms other than hydrogen atoms, and one of the hydrogen atoms on the nitrogen atoms in said triazole ring or any of its tautomeric forms can be replaced by the same or different substituent as defined for R, provided that none of said substituents is an aminoalkyl group, and any two adjacent substituents can together form a fused ring with said triazole ring, wherein the concentration of ammonium ions is at least 50 mol % of all cations in said composition.

2. The fixing composition of claim 1 wherein R is an aliphatic, alicyclic or aromatic substituent.

3. The fixing composition of claim 2 wherein R is hydrogen, an alkyl group, a cycloalkyl group, an aryl group, an amino group, an alkoxy group, an acyl group, an aryloxy group, alkylthio group, arylthio group or a heterocyclyl group, and the compound of Structure I has no more than one aliphatic, alicyclic or aromatic group attached to the ring at the 1-, 2-, or 4-position.

4. The fixing composition of claim 3 wherein R is an alkyl group, a sulfoalkyl group or an amino group.

5. The fixing composition of claim 1 wherein the compound of Structure I is further represented by Structure Ia:

Structure Ia

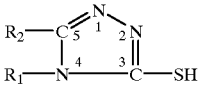

wherein $R_1$ and $R_2$ are independently hydrogen, an alkyl group or an amino group.

6. The fixing composition of claim 5 wherein $R_1$ and $R_2$ are independently hydrogen, —$NH_2$, methyl or 2-sulfoethyl.

7. The fixing composition of claim 1 wherein said compound is any of Compounds 1 to 22

1

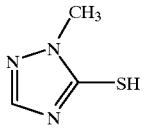

2

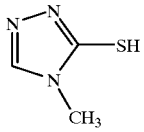

3

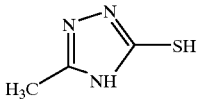

4

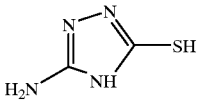

5

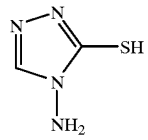

6

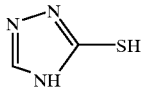

7

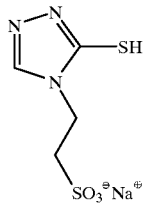

8

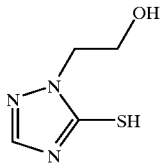

9

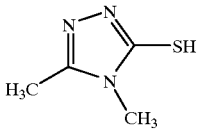

-continued

10

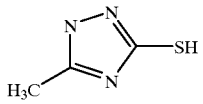

11

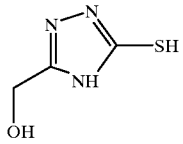

12

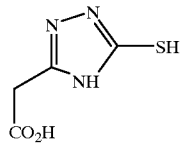

13

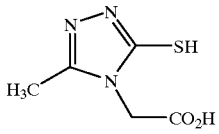

14

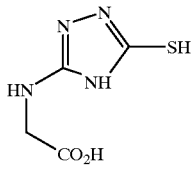

15

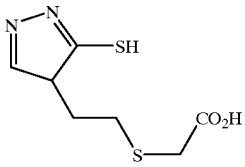

16

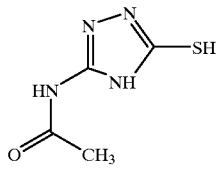

17

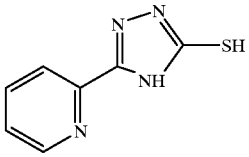

-continued

18

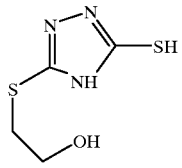

19

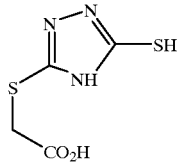

20

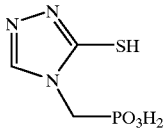

21

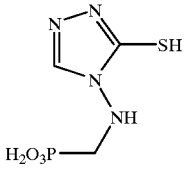

22

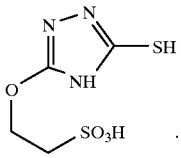

8. The fixing composition of claim 7 wherein the compound of Structure I is Compound 6 or 7

6

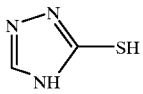

7

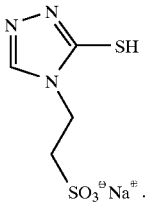

9. The fixing composition of claim 1 that is an aqueous composition having a pH of from about 4 to about 8.

10. The fixing composition of claim 1 wherein said thiosulfate fixing agent is present at a concentration of from about 1 to about 1.5 mol/l, and said thiocyanate fixing agent is present at a concentration of from about 2 to about 3 mol/l.

11. The fixing composition of claim 1 wherein said triazole of Structure I is present at a concentration of from about 0.001 to about 0.05 mol/l.

12. The fixing composition of claim 11 wherein said triazole of Structure I is present at a concentration of from about 0.005 to about 0.05 mol/l.

13. The fixing composition of claim 1 wherein the concentration of ammonium ions is at least 75 mol % of all cations.

14. An aqueous fixing composition having a pH of from about 4 to about 6, and comprising:

a) from about 1 to about 1.5 mol/l of a thiosulfate fixing agent, b) from about 2 to about 3 mol/l of a thiocyanate fixing agent, and c) from about 0.005 to about 0.05 mol/l of 3-mercapto-1,2,4-triazole, wherein the concentration of ammonium ions is at least 75 mol % of all cations in said composition, and said composition contains no purposely added bleaching agents.

15. A method of photographic processing comprising:

contacting an imagewise exposed and color developed color photographic silver halide element with the fixing composition of claim 1 for up to 50 seconds.

16. The method of claim 15 wherein said element has been bleached before contacting with said fixing composition.

17. The method of claim 15 wherein said contacting is carried out for up to 45 seconds.

18. The method of claim 15 wherein said contacting is carried out for from about 30 to about 45 seconds.

19. The method of claim 15 wherein at least 95 mol % of the original removable silver(I) in said element is dissolved during said contacting step, and the residual dye stain after contacting with said fixing composition is less than 0.05 density units of dye stain density in the region of 600 to 700 nm.

20. The method of claim 15 wherein said color photographic silver halide element is a color negative film.

21. The method of claim 15 wherein said contacting is carried out at a temperature of from about 20 to about 60° C.

22. A method of photographic processing comprising:

A) color developing an imagewise exposed color negative film with a color development composition comprising a color developing agent, B) bleaching said color developed color negative film with a bleaching composition comprising a bleaching agent, C) fixing said bleached color negative film for at least and up to 45 seconds with a fixing composition having a pH of from about 4 to about 8 and comprising:

a) from about 1 to about 1.5 mol/l of a thiosulfate fixing agent, b) from about 2 to about 3 mol/l of a thiocyanate fixing agent, and c) at least 0.005 mol/l of a compound of Structure Ia:

Structure Ia

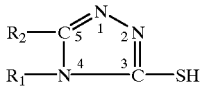

wherein $R_1$ and $R_2$ are independently hydrogen, an alkyl group or an amino group, wherein the concentration of ammonium ions is at least 75 mol % of all cations in said fixing composition, and D) rinsing or stabilizing said fixed color negative film with a rinsing or stabilizing composition.

23. The method of claim 22 wherein said fixing step C is carried out at a temperature of from about 30 to about 50° C., and said fixing composition contains no purposely added bleaching agents.

24. The method of claim 22 wherein said color developing step A is carried out for from about 12 to about 150 seconds, said bleaching step B is carried out for from about 12 to about 50 seconds, and said stabilizing or rinsing step D is carried out for from about 15 to about 50 seconds.

25. The method of claim 22 that is carried out within a total time of from about 120 to about 300 seconds for steps A through D.

26. The method of claim 15 wherein said triazole of Structure I is any of Compounds 1 to 22

1

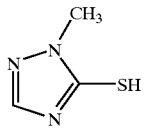

2

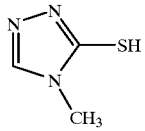

3

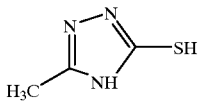

4

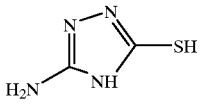

5

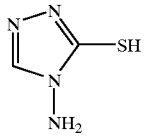

6

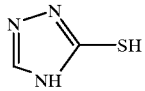

7
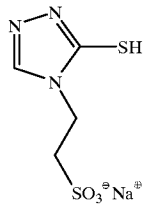
8
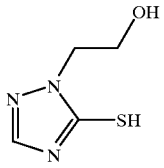
9
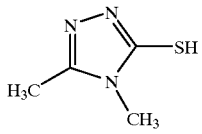
10
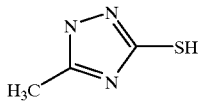
11
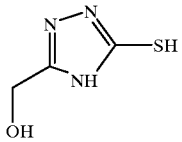
12
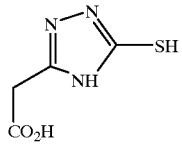
13
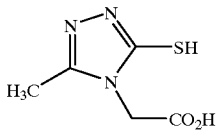
14
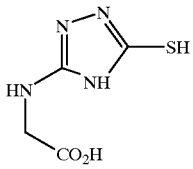
15
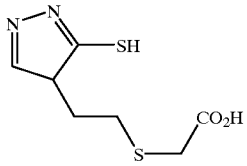
16
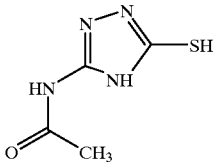
17
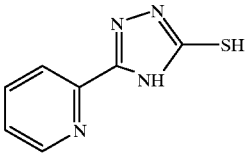
18
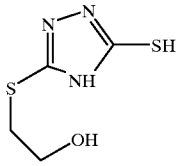
19
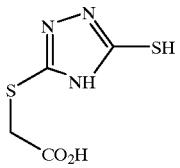
20
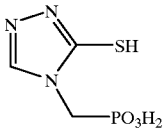
21
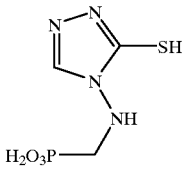
22
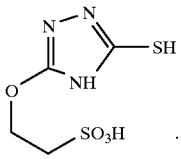

* * * * *